US011725427B2

(12) United States Patent
Schmidt et al.

(10) Patent No.: US 11,725,427 B2
(45) Date of Patent: Aug. 15, 2023

(54) METHOD FOR OPERATING AN OPENING MECHANISM

(71) Applicant: Volkswagen Aktiengesellschaft, Wolfsburg (DE)

(72) Inventors: Tatjana Schmidt, Leverkusen (DE); Serkan Guelkan, Hattingen (DE); Kay-Olaf Loock, Wolfsburg (DE); Peter Jencus, Braunschweig (DE); Christoph Fuchs, Hoedingen (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 556 days.

(21) Appl. No.: 16/599,799

(22) Filed: Oct. 11, 2019

(65) Prior Publication Data

US 2020/0115930 A1 Apr. 16, 2020

(30) Foreign Application Priority Data

Oct. 11, 2018 (DE) ..... 10 2018 125 208.0

(51) Int. Cl.
*E05B 77/22* (2014.01)
*E05B 81/56* (2014.01)
(Continued)

(52) U.S. Cl.
CPC ..... *E05B 77/22* (2013.01); *E05B 81/16* (2013.01); *E05B 81/56* (2013.01); *E05B 81/64* (2013.01)

(58) Field of Classification Search
CPC ..... E05B 81/16; E05B 81/56; E05B 81/90; E05B 81/25; E05B 81/64; E05B 81/06; E05B 81/00; E05B 81/42; E05B 81/14; E05B 81/04; E05B 85/00; E05B 79/10; E05B 79/20; E05B 77/22; E05B 17/0029; E05B 81/30; Y10T 292/1047; Y10T 292/1082; Y10S 292/23
See application file for complete search history.

(56) References Cited

U.S. PATENT DOCUMENTS

2018/0016820 A1* 1/2018 Takagi ..... E05B 81/06
2021/0164268 A1* 6/2021 Grzonka ..... E05B 85/26

FOREIGN PATENT DOCUMENTS

DE 19924458 12/2000
DE 19924458 A1 * 12/2000 ..... E05B 77/26
(Continued)

*Primary Examiner* — Christine M Mills
*Assistant Examiner* — Peter H Watson
(74) *Attorney, Agent, or Firm* — Pauly, DeVries Smith & Deffner LLC

(57) ABSTRACT

Various embodiments provide a method for operating an opening mechanism which serves for the opening of a motor vehicle lock, wherein the opening mechanism is formed separately from the motor vehicle lock and, for the opening, is coupled mechanically to the motor vehicle lock, wherein the opening mechanism is assigned a control arrangement, a switchable coupling arrangement, an actuating lever and an electric drive arrangement. It is proposed that the overall pivoting region of the actuating lever starting from the starting position comprises a first pivoting region and a second pivoting region following the latter, wherein the motorized opening operation can be triggered by means of the drive arrangement by means of an actuating stroke over the first pivoting region.

16 Claims, 6 Drawing Sheets

(51) Int. Cl.
*E05B 81/64* (2014.01)
*E05B 81/16* (2014.01)

(56) References Cited

FOREIGN PATENT DOCUMENTS

| | | | | | |
|---|---|---|---|---|---|
| DE | 102014109111 | A1 | * | 12/2015 | ..... E05B 81/14 |
| DE | 102016218299 | A1 | * | 3/2017 | ..... E05B 77/04 |
| EP | 2492423 | A2 | * | 8/2012 | ..... E05B 77/36 |
| EP | 3147433 | A2 | * | 3/2017 | ..... E05B 47/0009 |
| GB | 2350644 | A | * | 12/2000 | ..... E05B 77/28 |
| JP | 2009221652 | A | * | 10/2009 | ..... E05F 15/43 |
| WO | WO-2019202750 | A1 | * | 10/2019 | ..... E05B 77/30 |

* cited by examiner

METHOD FOR OPERATING AN OPENING MECHANISM

CLAIM OF PRIORITY

This application claims the benefit of German Patent Application No. DE 10 2018 125 208.0 filed on Oct. 11, 2018, the disclosure of which is incorporated herein by reference.

FIELD OF THE TECHNOLOGY

The disclosure relates to a method for operating an opening mechanism which serves for opening a motor vehicle lock, and an opening mechanism for carrying out such a method.

BACKGROUND

The term "motor vehicle lock" is summarized here as meaning all types of door locks, hood locks or flap locks.

The opening mechanism under discussion serves for opening a motor vehicle lock in a motorized opening operation. In the event that the motorized opening operation does not function, a manual opening operation is provided. This is referred to in principle as "mechanical redundancy".

The known method for operating an opening mechanism (DE 199 24 458 B4), from which the disclosure proceeds, is based on the above concept of mechanical redundancy. When an actuating lever is first deflected, a motorized opening operation is triggered via an electric switching contact. In the event that the motorized opening operation does not function, the manual actuating stroke is continued further such that, after a mechanical pressure point is passed over, a manual opening operation is produced. With the known method, maximum operating safety for opening the motor vehicle lock can be achieved if a malfunction occurs during the motorized opening operation. The known method does not take into consideration risks which arise only when a successful opening operation is carried out. These include, for example, the risk of collision of the motor vehicle door being opened with an approaching motor vehicle or the like.

SUMMARY

The disclosure is based on the problem of designing and developing the known method in such a manner that the operating safety is increased further.

The above problem is achieved in a method for operating an opening mechanism, which serves for opening a motor vehicle lock.

The basic consideration of using a special opening mechanism with mechanical redundancy and of reacting to the receipt of a surroundings warning signal with a time-delayed motorized opening operation in order to increase the operating safety is fundamental.

First of all, the opening mechanism used is formed separately from the motor vehicle lock and, for the opening, is coupled mechanically to the motor vehicle lock such that the method according to the proposal can be used in any already existing motor vehicle lock.

Within the context of mechanical redundancy, the opening mechanism is configured both for a motorized opening operation and for a manual opening operation. For the two opening operations, the opening mechanism has a triggering lever, by means of the triggering movement of which the motor vehicle lock is opened.

For the motorized opening operation, the opening mechanism has an electric drive arrangement, by means of which the triggering movement of the triggering lever and therefore a motorized opening operation are produced.

By contrast, for a manual opening operation, the opening mechanism is provided with double stroke triggering by means of an actuating lever which is coupled mechanically to a door handle, here to an inside door handle. A switchable coupling arrangement is provided between the actuating lever and the triggering lever and engages in a first actuating stroke of the actuating lever such that, with a subsequent actuating stroke, the triggering movement of the triggering lever and therefore the opening of the motor vehicle lock are produced.

The overall pivoting region of the actuating lever starting from the starting position comprises a first pivoting region and a second pivoting region following the latter, wherein the motorized opening operation can be basically triggered by means of an actuating stroke over the first pivoting region.

However, according to the proposal, the triggering of the motorized opening operation is subject to the receipt of a surroundings warning signal from a surroundings warning unit. According to the proposal, it is provided in this context that, upon the receipt of the surroundings warning signal, the motorized opening operation is deactivated over a predetermined time delay. This means, for example, that the drive arrangement of the opening mechanism remains unenergized over the predetermined time delay.

It is now essential that, when the motorized opening operation is deactivated and the coupling arrangement is in the disengaged state, engagement of the coupling arrangement is brought about by means of an actuating stroke extending over the two pivoting regions and, in the process, the transition from the first pivoting region to the second pivoting region is associated with a, here abrupt, rise in the actuating force. A manual opening operation can then be produced by means of a subsequent actuating stroke over the two pivoting regions.

According to the proposal, a special opening mechanism with mechanical redundancy has therefore been used in order to react to the receipt of a surroundings warning signal. During the time delay, according to the proposal, of the motorized opening operation, the operator retains the possibility of double stroke triggering of the manual opening operation, for which, however, the, abrupt, rise in the actuating force has to be overcome. The effect therefore achieved is that a certain time delay arises even in the mechanical respect since the operator in addition to overcoming the increased actuating force additionally has to carry out a double stroke. This provides the operator—consciously or unconsciously—with the opportunity of checking the operator's request to open the motor vehicle lock. Increased operating safety results from the solution according to the proposal because of the reduced risk of an ill-considered opening operation with possible imminent collision with the surroundings.

In various embodiments, the surroundings warning signal is a collision warning signal while the surroundings warning unit then has a collision sensor, here a distance sensor. For such a distance sensor, inductive, capacitive, optical or acoustic distance sensors, inter alia, can be used. As discussed above, the deactivation of the motorized opening operation can stem from currentless switching of the electric drive arrangement. Other variants for the deactivation of the motorized opening operation in such a manner that triggering of the motorized opening operation does not take place are conceivable.

Various embodiments relate to the provision of the coupling arrangement with a coupling lever which can be adjusted into an engagement position and a disengagement position, depending on the coupling state. In a variant which can be preassembled particularly readily, the coupling lever is mounted pivotably on the actuating lever.

Various embodiments relate to the use of a control contour which, firstly, realizes the double stroke function and which secondly is the cause of the rise, according to the proposal. Said double use of the control contour leads to a particularly compact and at the same time cost-effective structural design of the opening mechanism.

Particularly great flexibility with regard to the setting of the coupling state of the coupling arrangement is produced by means of the adjustability of the coupling lever by means of the drive arrangement. Particularly advantageously, the coupling lever is adjusted here from the engagement position into the disengagement position since the reverse adjustment is actually provided by the first actuating stroke of the double stroke triggering of the manual opening operation.

In various embodiments, the opening mechanism is assigned a sensor arrangement for detecting an actuating stroke over the first pivoting region. The sensor arrangement serves for triggering the motorized opening operation by corresponding activation of the drive arrangement. In principle, however, the sensor arrangement can also be provided in a door handle assigned to the motor vehicle lock arrangement, in particular an inside door handle.

According to various embodiments, an opening mechanism which serves for opening a motor vehicle lock in order to carry out the method according to the proposal is disclosed. Reference should be made to all of the explanations regarding the first-mentioned teaching.

Various embodiments provide a method for operating an opening mechanism which serves for opening a motor vehicle lock, wherein the opening mechanism is formed separately from the motor vehicle lock and, for the opening, is coupled mechanically to the motor vehicle lock, wherein the opening mechanism is assigned a control arrangement, wherein the opening mechanism has a triggering lever, by means of the triggering movement of which the motor vehicle lock is opened, wherein the opening mechanism has an electric drive arrangement, wherein the triggering movement of the triggering lever and therefore a motorized opening operation are produced by means of the drive arrangement, wherein the opening mechanism has an actuating lever which is coupled to a door handle, in particular to an inside door handle, and which is actuated from a starting position in a manual actuating stroke consisting of a forwards and return movement, wherein the opening mechanism has a switchable coupling arrangement between the actuating lever and the triggering lever, and wherein a manual opening operation is produced by means of the actuating lever via the coupling arrangement, wherein the overall pivoting region of the actuating lever starting from the starting position comprises a first pivoting region and a second pivoting region following the latter, wherein the motorized opening operation can be triggered by means of an actuating stroke over the first pivoting region, wherein a surroundings warning signal from a surroundings warning unit is received by means of the control arrangement, and wherein upon the receipt of the surroundings warning signal by means of the control arrangement, the motorized opening operation is deactivated via a predetermined time delay, wherein, when the motorized opening operation is deactivated and when the coupling arrangement is in the disengaged state, engagement of the coupling arrangement is brought about by means of an actuating stroke over the two pivoting regions and, in the process, the transition from the first pivoting region to the second pivoting region is associated with an, in particular abrupt, rise in the actuating force, and wherein a manual opening operation is produced by means of a subsequent actuating stroke over the two pivoting regions.

In some embodiments, the surroundings warning signal is a collision warning signal, and in that the surroundings warning unit has a collision sensor, in particular a distance sensor.

In some embodiments, the deactivation of the motorized opening operation stems from currentless switching of the electric drive arrangement.

In some embodiments, the coupling arrangement has a coupling lever which is adjusted between an engagement position, in which the actuating lever is coupled or can be coupled to the triggering lever via the coupling lever, and a disengagement position, in which the actuating lever is decoupled from the triggering lever, such as in that the coupling lever is pretensioned into the engagement position or the disengagement position, depending on the coupling state, by means of a tilting spring.

In some embodiments, a control contour is provided along which the coupling lever or an element coupled to the coupling lever when the coupling lever is initially in the disengagement position slides during the forwards movement of the actuating stroke and the coupling lever is thereby guided from the disengagement position in the direction of the engagement position, such as in that, during the subsequent return movement of the actuating stroke, the coupling lever or an element coupled to the coupling lever slides along the triggering lever and is thereby guided into the engagement position.

In some embodiments, the control contour has a braking contour portion which is configured in such a manner that, during the forwards movement of the actuating stroke, during the transition from the first pivoting region to the second pivoting region, an increased deflection rate of the coupling lever is generated based on the deflection of the actuating lever and therefore a rise in the actuating force.

In some embodiments, the coupling lever in the engagement position is adjusted into the disengagement position by means of the drive arrangement, such as in that the coupling lever in the engagement position can be adjusted into the disengagement position in a motorized opening operation.

In some embodiments, the actuating lever or an element coupled to the actuating lever is assigned a sensor arrangement, in particular a switching element, for detecting the position of the actuating lever, and in that the arrangement is undertaken in such a manner that, upon the detection of an actuating stroke over the first pivoting region, the drive arrangement is activated in order to generate the motorized opening operation.

Various embodiments provide an opening mechanism for carrying out the method as described herein.

BRIEF DESCRIPTION OF THE DRAWINGS

The disclosure will be explained in more detail below with reference to a drawing illustrating just one exemplary embodiment. In the drawing

DETAILED DESCRIPTION

The opening mechanism 1 according to the proposal, designed for carrying out the method according to the proposal, serves for opening a motor vehicle lock 2. As discussed further above, the term "motor vehicle lock" combines all types of door locks, hood locks or flap locks. The motor vehicle lock 2 is assigned here to a motor vehicle door T configured as a side door. All of the explanations in this regard apply correspondingly to all other types of motor vehicle locks.

Figure 1:
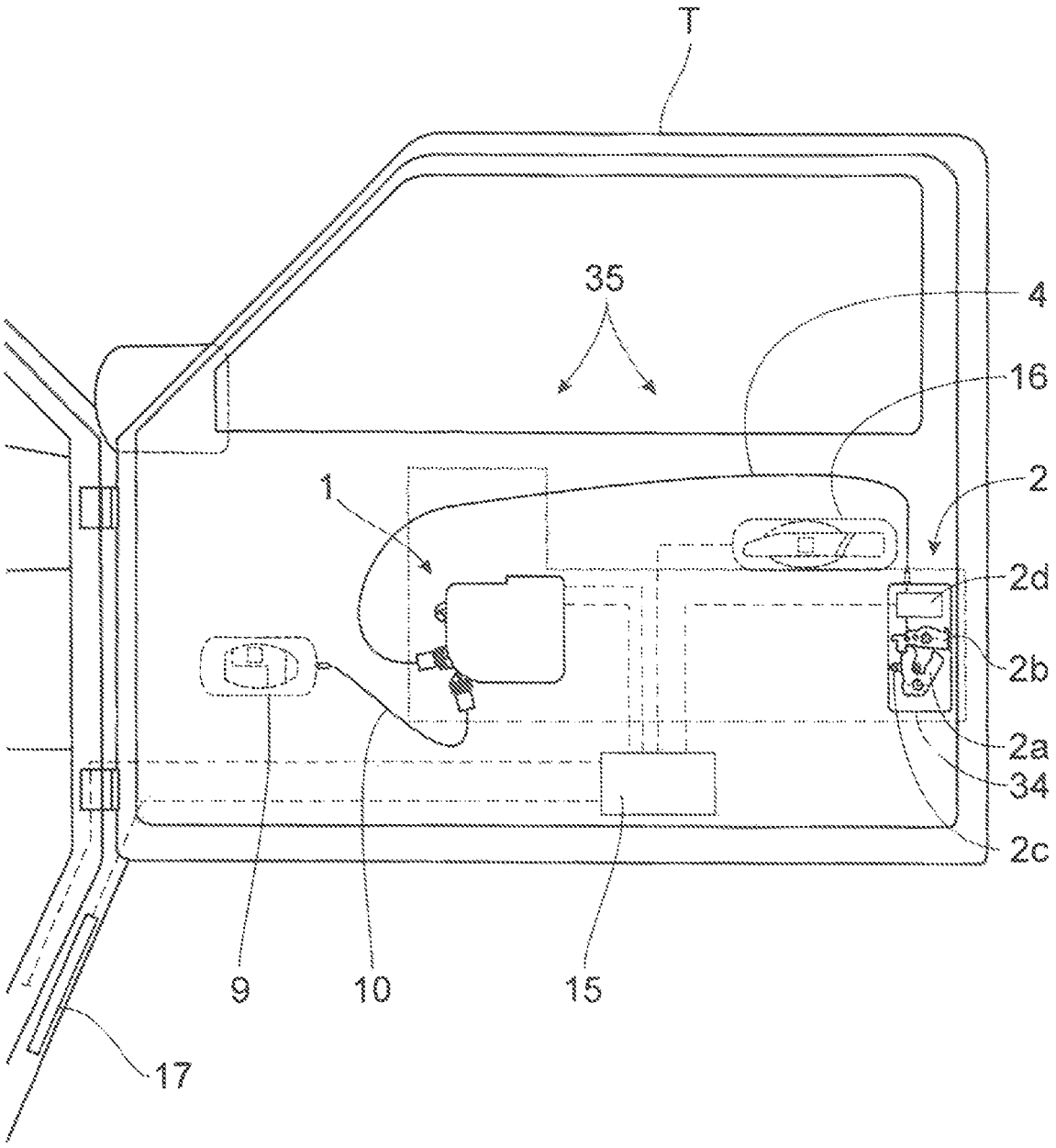
FIG. 1 shows a motor vehicle door with a motor vehicle lock arrangement according to the proposal, which is equipped with an opening mechanism according to the proposal, in an entirely schematic illustration.

As indicated in FIG. 1, the motor vehicle lock 2 has the conventional design with a lock latch 2*a* and pawl 2*b*. The lock latch 2*a* can be brought into at least one locking position, which is shown in FIG. 1, in which the lock latch 2*a* is blocked by the pawl 2*b* and in which the lock latch 2*a* is in holding engagement with a locking element 2*c*, here with a locking clip. While the motor vehicle lock 2 is arranged on the motor vehicle door T, the locking element 2*c*, merely indicated here, is located on the motor vehicle body. This may also be provided the other way around.

In order to open the motor vehicle lock 2, lifting out of the pawl 2*b*, in FIG. 1 pivoting of the pawl 2*b* in the clockwise direction, is required such that the lock latch 2*a* can pivot in the opening direction, likewise in the clockwise direction in FIG. 1, and can release the locking element 2*c*.

The opening mechanism 1 has a triggering lever 3, by means of the triggering movement of which the motor vehicle lock 2 in the mounted state can be opened. In the mounted state illustrated in FIG. 1, the triggering lever 3 is coupled for this purpose mechanically to the motor vehicle lock 2, here to the pawl 2*b* of the motor vehicle lock 2. Said mechanical coupling can be realized via a Bowden cable 4. Alternatively, a linkage or the like can also be used here.

Figure 2:
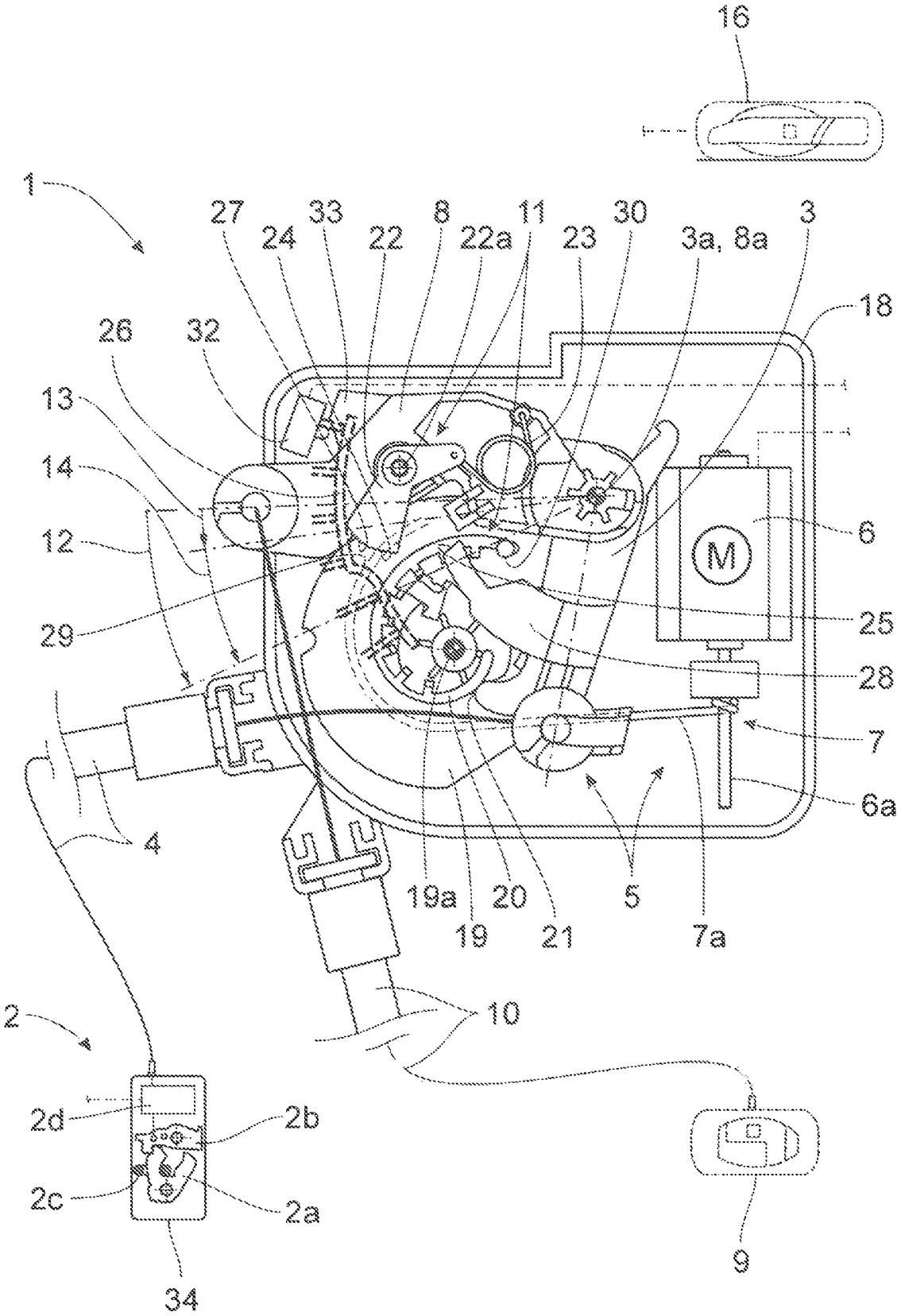
FIG. 2 shows the opening mechanism according to FIG. 1 in the state unactuated manually and by motor and partially disassembled.
Figure 3:
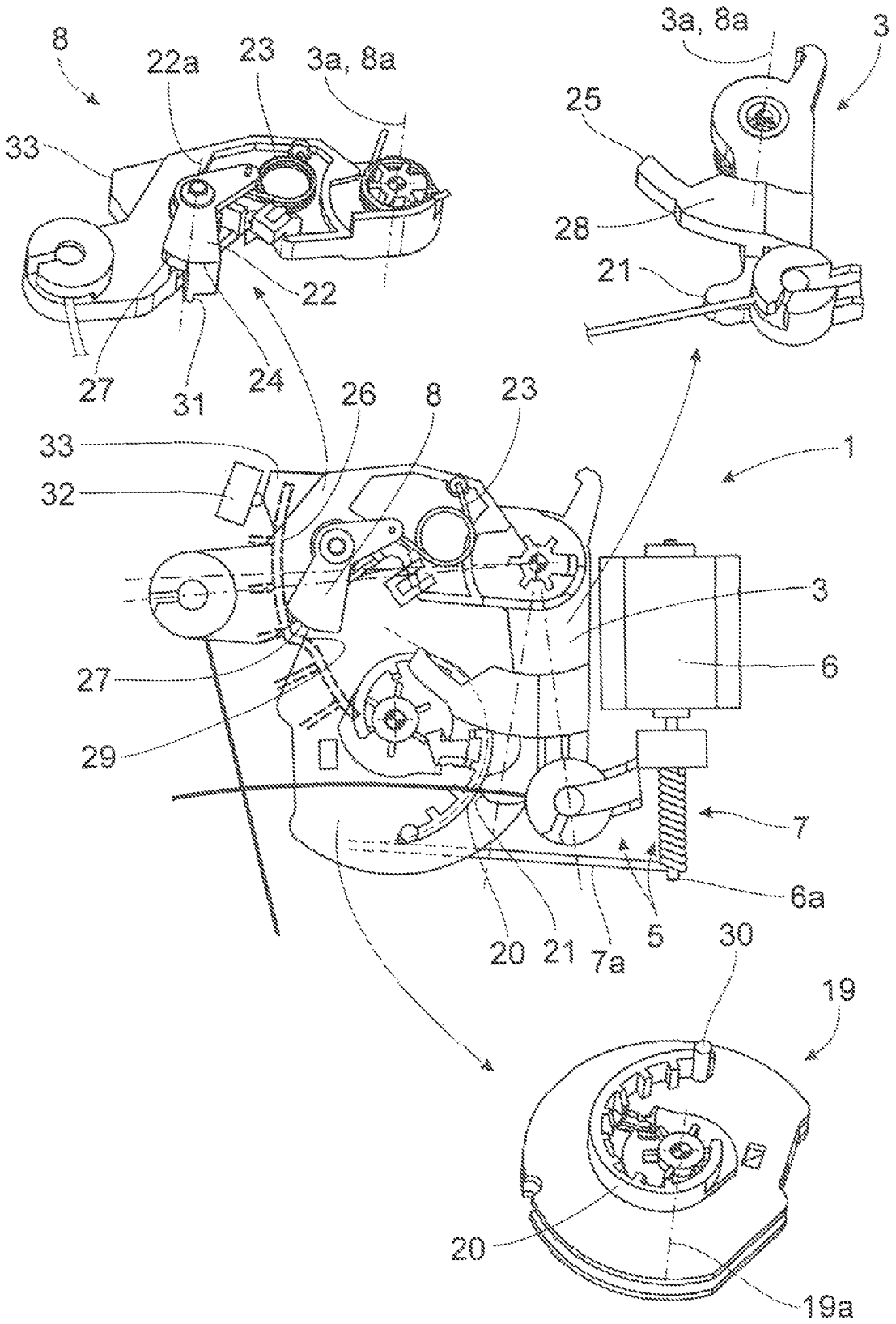
FIG. 3 shows the opening mechanism according to FIG. 2 at the end of the motorized opening operation.

As illustrated in FIGS. 2 to 6, the opening mechanism 1 has an electric drive arrangement 5 with a drive motor 6 and a feed mechanism 7 connected downstream of the drive motor 6, here a cable mechanism. The triggering movement of the triggering lever 3 and therefore a motorized opening operation can be produced by means of the drive arrangement 5. This is illustrated in FIG. 3. The cable 7*a* of the feed mechanism 7 is wound up on the motor shaft 6*a* of the drive motor 6, thus resulting in a feed movement which is conducted in a manner still to be explained to the triggering lever 3 and via the Bowden cable 4 to the pawl 2*b* of the motor vehicle lock 2.

In order to realize the mechanical redundancy, the opening mechanism 1 has an actuating lever 8 which, in the mounted state, is coupled mechanically to a door handle, here to an inside door handle 9. In the exemplary embodiment which is illustrated in FIG. 1, the mechanical coupling between the inside door handle 9 and the actuating lever 8 is realized via a further Bowden cable 10. A linkage or the like can also be used here.

The actuating lever 8 can be actuated from the starting position, illustrated in FIG. 2, in a manual actuating stroke, which stems here from an operator-side actuation of the inside door handle 9, consisting of a forwards and return movement. A complete actuating stroke is shown, for example, from the sequence of FIGS. 2, 4*a*, 4*b*, 5*a* and 5*b*.

In order to permit the double stroke triggering, which has yet to be explained, of the manual opening operation, the opening mechanism 1 furthermore has a switchable coupling arrangement 11 between the actuating lever 8 and the triggering lever 3, wherein a manual opening operation, i.e. a lifting out of the pawl 2*b*, can be produced by means of the actuating lever 8 via the coupling arrangement 11. The coupling arrangement 11 can be brought into a disengaged state (FIG. 2) and into an engaged state (FIG. 5*b*), as will also be explained.

The overall pivoting region 12 of the actuating lever 8, i.e. the entire pivoting region provided for the actuating strokes, according to normal operation, of the actuating lever 8, comprises, starting from the starting position shown in FIG. 2, a first pivoting region 13 and a second pivoting region 14 following the latter. The two pivoting regions 13, 14 are illustrated in FIG. 2. It is apparent from this illustration that the first pivoting region 13 is smaller than the second pivoting region 14. The first pivoting region 13 can extend over less than 40%, furthermore over less than 30%, furthermore over less than 25%, of the overall pivoting region 12.

According to the proposal, the motorized opening operation can be triggered by means of an actuating stroke over the first pivoting region 13. The end of the forwards movement of such an actuating stroke is illustrated in FIG. 4*a*. Such an actuating stroke which is focused on the triggering of the motorized opening operation is concluded with a return movement which, in turn, ends in the starting position shown in FIG. 2. In order to ensure the return movement, the actuating lever 8 can be spring-pretensioned into the starting position.

An overall view of FIGS. 2 and 4*a* reveals that the actuating stroke over the first pivoting region 13 stemming here from a slight actuation of the inside door handle 9 has virtually no effect on the opening mechanism 1, in particular no effect on the triggering lever 3. It is here to a certain extent a free-wheeling movement which serves merely to trigger the motorized opening operation. For the triggering of the motorized opening operation, said actuating stroke over the first pivoting region 13 can be sensed by sensor, as will also be explained. In FIG. 3, which shows the end of the motorized opening operation, the return movement of the actuating stroke over the first pivoting region 13 is already proceeding since the operator is just in the process of releasing the inside door handle 9 again.

Figure 4:
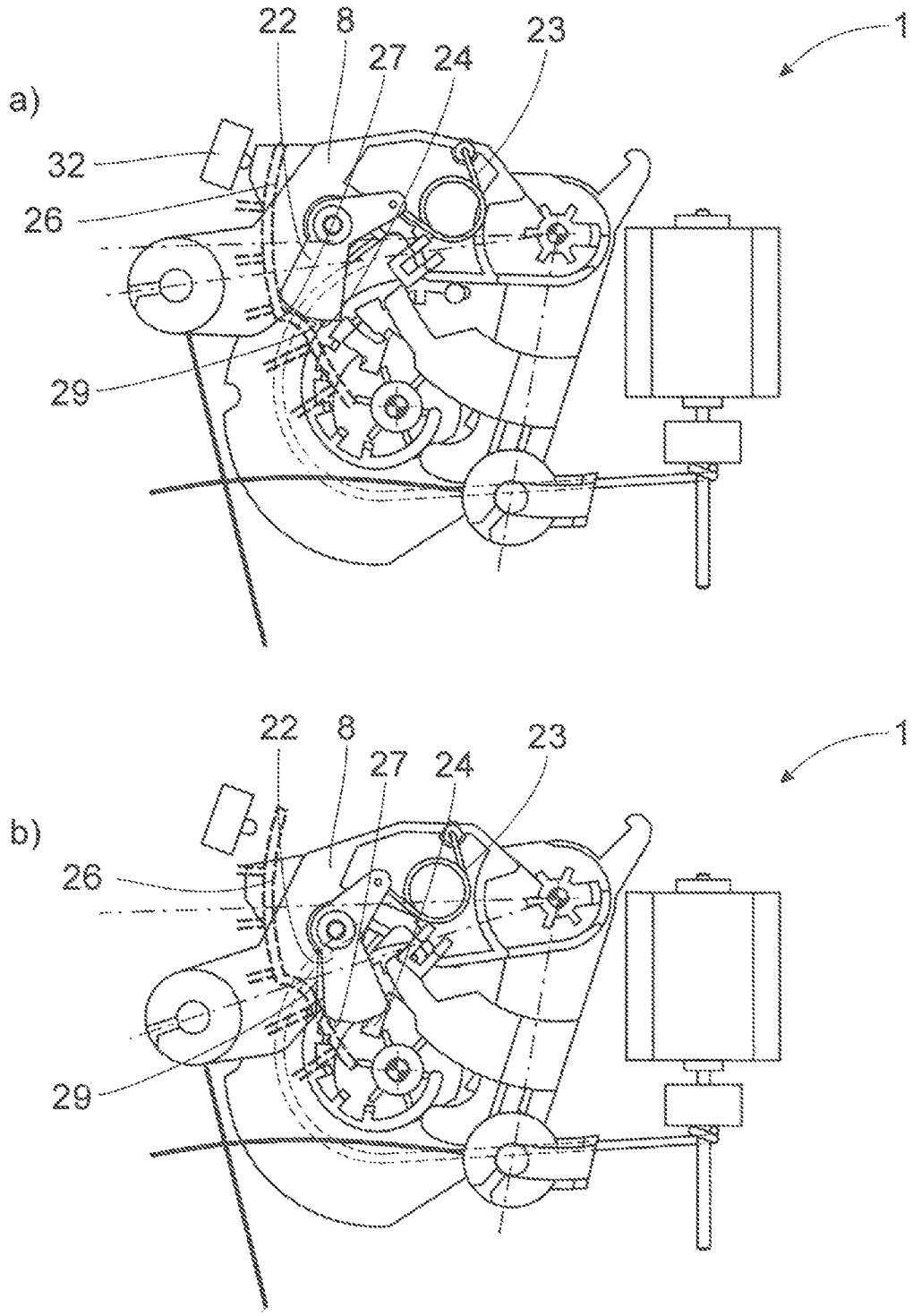
FIG. 4 shows the opening mechanism according to FIG. 2 during the forwards movement of the first actuating stroke of the double stroke triggering a) at the end of the first pivoting region and b) at the end of the second pivoting region.
Figure 5:
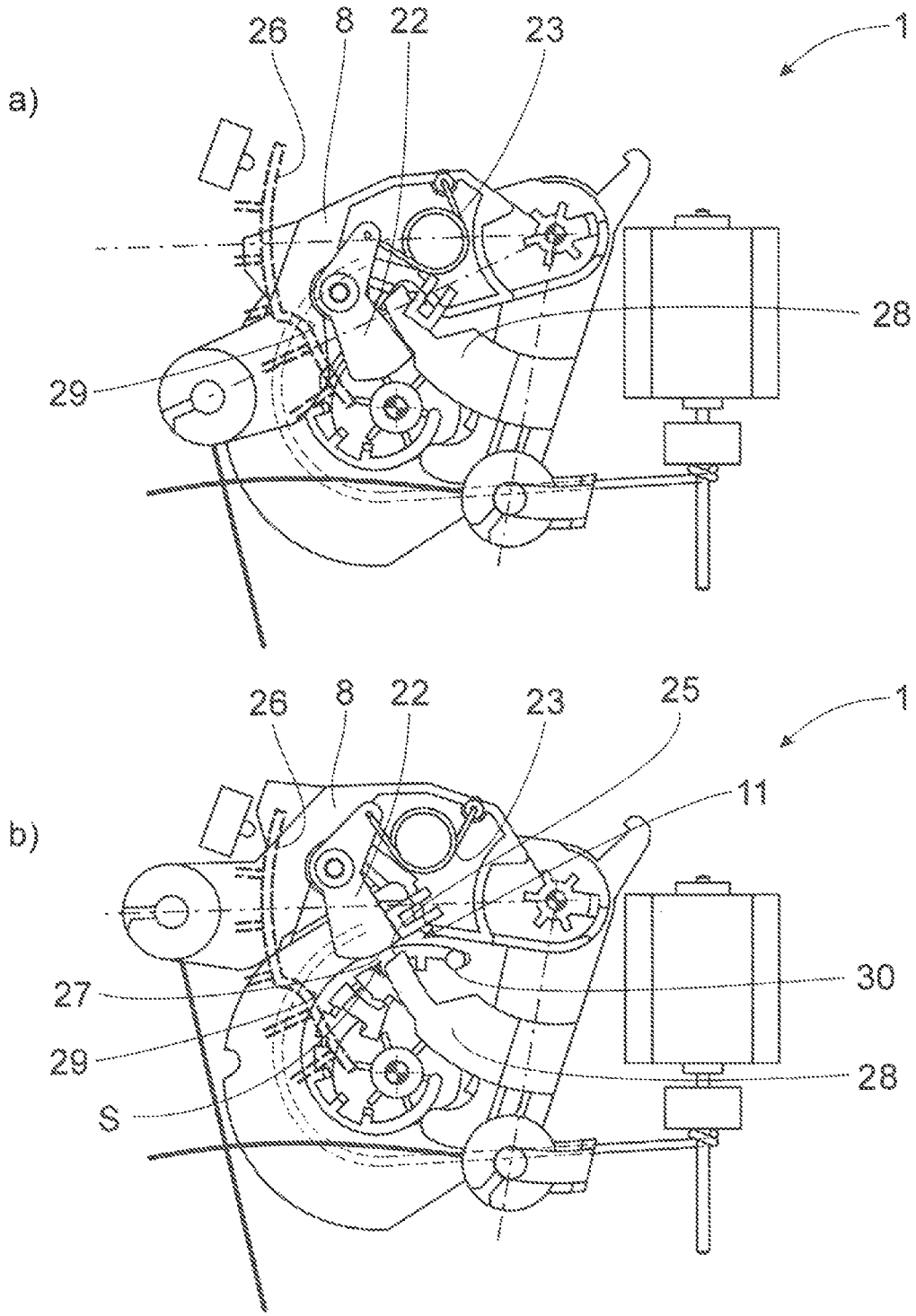
FIG. 5 shows the opening mechanism according to FIG. 2 during the return movement of the first actuating stroke of the double stroke triggering a) before the coupling lever latches into the engagement position and b) after the coupling lever has latched into the engagement position.
Figure 6:
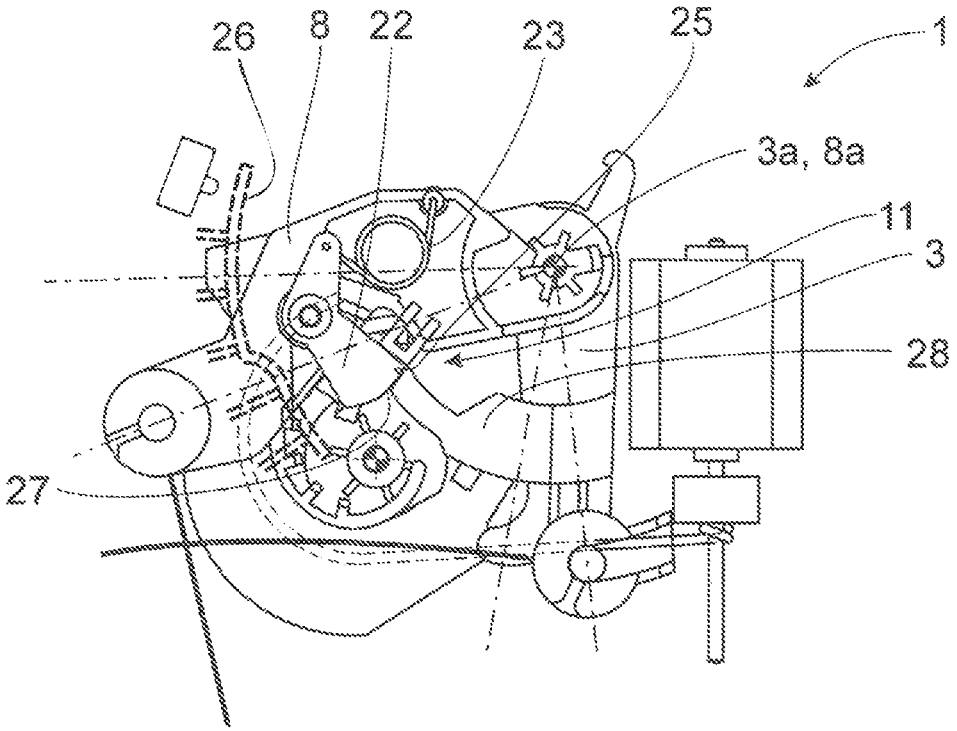
FIG. 6 shows the opening mechanism according to FIG. 2 during the forwards movement of the second actuating stroke of the double stroke triggering.

FIGS. 4, 5 and 6 relate to the situation of deactivation of the motorized opening operation. The deactivation of the motorized opening operation means that an actuating stroke extending only over the first pivoting region 13 does not trigger the motorized opening operation. When the coupling arrangement 11 is in the disengaged state (FIG. 2), engagement of the coupling arrangement 11 can then be brought about by means of an actuating stroke extending over the two pivoting regions 13, 14. The transition from the first pivoting region 13 to the second pivoting region 14 is associated here with a, here an abrupt, rise in the actuating force.

The term "abruptly" means in general here that the rise in the actuating force at a step change which can lie precisely between the first pivoting region 13 and the second pivoting region 14 is discontinuous over the adjustment of the actuating lever 8. The adjustment of the actuating lever 8 is opposed to a certain extent by a flexible stop.

Said first actuating stroke corresponds to the sequence of FIGS. 2, 4*a* and 4*b*. The transition from the first pivoting region 13 to the second pivoting region 14 takes place at the time shown in FIG. 4*a*. An engagement of the coupling arrangement 11 is therefore associated with said first actuating stroke when the rise in the actuating force is overcome. With a subsequent second actuating stroke over the two pivoting regions 13, 14, a manual opening operation can then be produced since the coupling arrangement 11 is already in the engaged state because of the first actuating stroke. A double stroke triggering of the manual opening operation is therefore realized.

The solution according to the proposal and described up to this point is associated with particularly high operating safety as has been explained in the general part of the description. Added to this is the fact that, in the unactuated state, the coupling arrangement 11 is in the disengaged state, and therefore accelerations which occur in the event of a crash and can bring about a movement of the actuating lever 8 do not produce an undesirable opening operation.

In the refinement which is shown in FIG. 1, a control arrangement 15 is provided which serves for activating the drive arrangement 5. The control arrangement 15 is assigned to this extent to the opening mechanism 1. Here, the opening mechanism is part of the opening mechanism 1. In an embodiment, which is not illustrated here, the control arrangement 15 is accommodated in an opening mechanism housing 18 which is yet to be explained.

A function of the control arrangement 15 consists in the triggering of a motorized opening operation via an outside door handle 16 which is illustrated in FIG. 1 and here is an outside door handle 16 operating purely electrically. This means that there is no mechanical connection, but rather merely an electrical connection between the outside door handle 16 and the opening mechanism 1 and also the motor vehicle lock 2. Upon an actuation of the outside door handle 16, it is checked by the control arrangement 15 whether a motorized opening operation is intended to be carried out or not.

It is noteworthy in respect of the arrangement illustrated in FIG. 1 that the mechanical coupling between the triggering lever 3 and the pawl 2*b* is provided via a lock mechanism 2*d*. The lock mechanism 2*d* primarily takes on a coupling function. It is therefore ensured that the manual opening operation emanating from the opening mechanism 1 does not always bring about lifting out of the pawl 2*b*. This is advantageous in particular if the intention is to realize a theft protection function which is intended to prevent opening of the motor vehicle lock 2 from the inside door handle 9 after an unauthorized entry into the interior of the motor vehicle. The adjustment of the lock mechanism 2*d* into the coupling state "theft protection on" and into the coupling state "theft protection off" is undertaken here in a motorized manner by means of a theft protection drive assigned to the lock mechanism 2*d* and is triggered via the control arrangement 15.

For the deactivation according to the proposal of the motorized opening operation, the proposal provides a surroundings warning unit 17 which generates a surroundings warning signal. The surroundings warning unit 17 serves, for example, for determining an imminent collision in the event of the opening of the associated motor vehicle door T. It is now provided according to the proposal that a surroundings warning signal from the surroundings warning unit 17 is received by means of the control arrangement 15 when a corresponding warning state has been detected.

As discussed above, the motorized opening operation can be triggered by means of an actuating stroke over the first pivoting region 13. However, here it is provided that, upon receipt of the surroundings warning signal, the motorized opening operation is deactivated via a predetermined time delay such that the above double stroke triggering of the manual opening operation is required in order to open the motor vehicle lock 2. Said electrically and mechanically delayed opening operation is advantageous since the operator is provided with the opportunity of checking his/her opening request.

In some embodiments, the surroundings warning signal is a collision warning signal, wherein the surroundings warning unit 17 has a collision sensor, here a distance sensor. In the exemplary embodiment illustrated, the surroundings warning unit 17 is arranged in the form of a capacitive proximity sensor in the sill of the motor vehicle. Such a distance sensor makes it readily possible to sense whether the opening of the motor vehicle door T will cause a collision with the surroundings, in particular a house wall, a tree or the like. Another surroundings warning unit 17 can comprise the sensing of an approaching motor vehicle, a bicycle or the like. Yet other variants for the surroundings warning unit 17 are conceivable.

Numerous possibilities are conceivable for the deactivation of the motorized opening operation. Here, the deactivation of the motorized opening operation stems from currentless switching of the electric drive arrangement 5.

Depending on the haptic circumstances relating to the inside door handle 9, it can be provided that, when the coupling arrangement 11 is in the disengaged state, during the forwards movement of the actuating stroke the transition from the first pivoting region 13 to the second pivoting region 14 is associated with a, here an abrupt, rise in the actuating force at least by four times, such as at least by five times, furthermore at least by seven times. Said always clear rise in the actuating force is appropriate insofar as the manual opening operation comes into effect only in exceptional cases.

FIG. 2 shows that the opening mechanism has an opening mechanism housing 18 in which at least the triggering lever 3 and the actuating lever 8 are mounted pivotably. It can be gathered from the illustration according to FIG. 2 that the triggering lever 3 and the actuating lever 8 are mounted about one and the same geometrical pivot axis 3*a*, 8*a*. As discussed further above, said concentric arrangement of triggering lever 3 and actuating lever 8 is compact and cost-efficient.

In the exemplary embodiment illustrated, the motorized opening operation is realized in a particularly compact and at the same time robust manner. For this purpose, the drive arrangement 5 has a pivotable adjustment element 19, the geometrical pivot axis 19*a* of which is spaced apart from the geometrical pivot axis 3*a*, 8*a*. In order to produce the triggering movement, an interaction takes place between the adjustment element 19 and the triggering lever 3. In detail, for this purpose the adjustment element 19 has a drive contour 20 for engagement with the triggering lever 3 or with an element coupled to the triggering lever 3. Here, the triggering lever 3 is provided with a drive surface 21 for engagement with the drive contour 20.

As discussed further above, the drive arrangement 5 here has a feed mechanism 7 which is designed as a cable mechanism. FIG. 2 shows that the cable 7*a* of the cable mechanism 7 interacts with the adjustment element 19 in a manner driving the latter in the anticlockwise direction in FIG. 2. The adjustment element 19 here takes on the function of a cable pulley, which in turn leads to a compact overall arrangement.

In the exemplary embodiment illustrated, the coupling arrangement 11 is realized in a particularly simple structural manner. It is first of all essential here that the coupling arrangement 11 has a coupling lever 22 which is adjustable between an engagement position (FIG. 5*b*), in which the actuating lever 8 is coupled or can be coupled to the triggering lever 3 via the coupling lever 22 apart from a gap S, and a disengagement position (FIG. 2), in which the actuating lever 8 is decoupled from the triggering lever 3. In some embodiments, the coupling lever 22 is pretensioned into the engagement position or the disengagement position, depending on the coupling state, by means of a tilting spring 23. It goes without saying that the engagement position of the coupling lever 22 corresponds to the engaged state of the coupling arrangement 11 and the disengagement position of the coupling lever 22 corresponds to the disengaged state of the coupling arrangement 11.

A compact arrangement which can in particular be pre-assembled in a simple manner arises here in that the coupling lever 22 is mounted on the actuating lever 8 so as to be pivotable between the engagement position and the disengagement position. The pivot axis 22*a* of the coupling lever 22 is arranged spaced apart here from the pivot axis 8*a* of the actuating lever 8. Alternatively, however, it can also be provided that the coupling lever 22 is mounted in the opening mechanism housing 18.

The resulting coupling function of the coupling arrangement 11 is realized in a very simple manner. The coupling lever 22 has a coupling contour 24 which, depending on the coupling state, interacts with a mating contour 25 of the triggering lever 3. When the coupling lever 22 is in the engagement position, the mating contour 25 is in the region of movement of the coupling contour 24 with respect to an actuating stroke of the actuating lever 8, and therefore the triggering lever 3 is carried along by the interaction between coupling contour 24 and mating contour 25 such that, as a result, the pawl 2*b* of the motor vehicle lock 2 is lifted out (FIG. 6).

When the coupling lever 22 is in the disengagement position, the mating contour 25 of the triggering lever 3 is located outside the movement region of the coupling contour 24 with respect to an actuating stroke of the actuating lever 8 such that the actuating lever 8 runs freely with respect to the triggering lever 3. However, this free-wheeling movement is in turn connected to an adjustment of the coupling lever 22, as will be explained below.

First of all, however, it should also be pointed out that the coaxial mounting of actuating lever 8 and triggering lever 3 is particularly advantageous in particular in respect of realizing the coupling arrangement 11 with the coupling lever 22 mounted on the actuating lever 8. This is shown in particular in that, during the manual opening operation when the coupling lever 22 is in the engagement position (FIG. 6), a relative movement between the coupling contour 24 and the mating contour 25 does not take place.

For the realization of the double stroke triggering, here a control contour 26 is provided along which the coupling lever 22 or an element coupled to the coupling lever 22 when the coupling lever 22 is initially in the disengagement position slides during the forwards movement of the actuating stroke and guides the coupling lever 22 from the disengagement position in the direction of the engagement position. This adjustment of the coupling lever 22 from the disengagement position in the direction of the engagement position arises from the transition from FIG. 4*a* to FIG. 4*b*. For this purpose, the coupling lever 22 has a starting contour 27 which is arranged separately from the coupling contour 24, but adjacent to the coupling contour 24. During the above sliding of the starting contour 27 along the control contour 26, the tilting point of the tilting spring 23 assigned to the coupling lever 22 is passed through, and therefore the coupling lever 22 snaps in the direction of the engagement position. Driven by the tilting spring 23, the coupling lever 22 now strikes against a drive arm 28 of the triggering lever 3, at the end of which the mating contour 25 is positioned. During the return movement of the first actuating stroke of the double stroke triggering, the coupling lever 22 latches completely into the engagement position as soon as the coupling lever has passed the mating contour 25 of the triggering lever 3. This can be gathered from the illustration according to FIG. 5*b*. A renewed actuating stroke then leads, as shown in FIG. 6, to the lifting out of the pawl 2*b*, as will be explained further below.

The control contour 26 can be fixed just as the geometrical mounting of the actuating lever 8 and of the triggering lever 3 is too. Here, the control contour 26 is arranged on the opening mechanism housing 18.

In the exemplary embodiment illustrated, it is then of interest that the control contour 26 serves not only for adjusting the coupling lever 22 but also crucially for the production of the above-discussed rise in the actuating force between the two pivoting regions 13, 14. For this purpose, the control contour 26 has a braking contour portion 29 which is configured in such a manner that, during the forwards movement of the actuating stroke, here the first actuating stroke of the double stroke triggering, it produces an increased deflection rate of the coupling lever 22 with respect to the deflection of the actuating lever 8 during the transition from the first pivoting region 13 to the second pivoting region 14 and thus a rise in the actuating force. This occurs in particular because of the fact that a corresponding deflection of the tilting spring 23 is associated with the increased deflection rate, this being associated with an increased contact force between the coupling lever 22 and the control contour 26 and therefore with an increased braking action.

It is furthermore noteworthy that the braking contour portion 29 is the same contour portion which is crucial for the deflection of the coupling lever 22 out of the disengagement position. The exemplary embodiment illustrated has particularly great flexibility in respect of the adjustment of the coupling lever 22. Here, the coupling lever 22 is namely adjustable by means of the drive arrangement 5, here by means of the adjustment element 19, into the disengagement position and/or into the engagement position. In some embodiments, the coupling lever 22 in the engagement position (FIG. 5*b*) is adjustable into the disengagement position in a motorized opening operation. In detail, it is provided from the situation illustrated in FIG. 5*b* that an engagement element 30 of the adjustment element 19 comes into engagement with a mating engagement element 31 on the coupling lever 22 by means of an adjustment of the adjustment element 19 in the anticlockwise direction, as a result of which the coupling lever 22 is brought back into the disengagement position. Particularly great flexibility during the resetting of the coupling lever 22 into the disengagement position is therefore possible.

In principle, an adjustment of the coupling lever 22 from the disengagement position into the engagement position by means of the adjustment element 19 is also possible if the adjustment element 19 is adjustable bidirectionally by means of the drive motor 6. For this purpose, the feed mechanism 7 can optionally be formed in the manner of a spur gear mechanism or the like since the cable mechanism 7 illustrated permits only a unidirectional transmission of force.

It has already been pointed out that the actuating stroke which triggers the motorized opening operation and extends over the first pivoting region 13 has to be sensed by sensor. Here, the actuating lever 8 or an element coupled to the actuating lever 8 is therefore assigned a sensor arrangement, in particular a switching element 32, for sensing the position of the actuating lever 8. Furthermore, the switching element 32 is a simple microswitch which interacts with a switching contour 33 on the actuating lever 8. As a result, the arrangement is undertaken in such a manner that, upon the sensing of an actuating stroke extending over the first pivoting region 13, the drive arrangement 5 is activated for producing the motorized opening operation if no other conditions to be met in terms of control technology are pending.

According to a further teaching, an opening mechanism is described which is configured for carrying out the method according to the proposal.

The opening mechanism 1 according to the proposal is coupled, for the opening, mechanically to the motor vehicle lock 2, wherein the opening mechanism 1 is assigned a control arrangement 15, wherein the opening mechanism 1 has a triggering lever 3, by means of the triggering movement of which the motor vehicle lock 2 in the mounted state is opened, wherein the opening mechanism 1 has an electric drive arrangement 5, wherein the triggering movement of the triggering lever 3 and therefore a motorized opening operation are produced by means of the drive arrangement 5, wherein the opening mechanism 1 has an actuating lever 8 which in the mounted state is coupled to a door handle, in particular to an inside door handle 9, and which is actuated from a starting position in a manual actuating stroke consisting of a forwards and return movement, wherein the opening mechanism 1 has a switchable coupling arrangement 11 between the actuating lever 8 and the triggering lever 3, and wherein a manual opening operation is produced by means of the actuating lever 8 via the coupling arrangement 11, wherein the overall pivoting region 12 of the actuating lever 8 starting from the starting position comprises a first pivoting region 13, and a second pivoting region 14 following the latter, wherein the motorized opening operation can be triggered by means of an actuating stroke over the first pivoting region 13 wherein, by means of the control arrangement 15, a surroundings warning signal is received by a surroundings warning unit 17, and wherein, by means of the control arrangement 15 upon the receipt of the surroundings warning signal, the motorized opening operation is deactivated via a predetermined time delay, wherein, when the motorized opening operation is deactivated and when the coupling arrangement 11 is in the disengaged state, engagement of the coupling arrangement 11 is brought about by means of an actuating stroke over the two pivoting regions 13, 14 and, in the process, the transition from the first pivoting region 13 to the second pivoting region 14 is associated with an, in particular abrupt, rise in the actuating force, and wherein a manual opening operation is produced by means of a subsequent actuating stroke over the two pivoting regions 13, 14. Reference should be made to all of the above explanations.

The invention claimed is:

1. A method for operating an opening mechanism which serves for opening a motor vehicle lock, wherein the opening mechanism is formed separately from the motor vehicle lock and the opening mechanism is spatially separated from the motor vehicle lock, wherein the motor vehicle lock has at least a lock latch and a pawl, and wherein, for the opening action, the opening mechanism is coupled mechanically to the motor vehicle lock, wherein the opening mechanism is assigned a control arrangement, wherein the opening mechanism comprises a triggering lever, by the triggering movement of which the motor vehicle lock is opened, wherein the opening mechanism comprises an electric drive arrangement, wherein the triggering movement of the triggering lever and therefore a motorized opening operation are produced by the electric drive arrangement, wherein the opening mechanism comprises an actuating lever which is coupled to a door handle and which is actuated from a starting position in a manual actuating stroke consisting of a forwards and return movement, wherein the opening mechanism comprises a switchable coupling arrangement between the actuating lever and the triggering lever, and wherein a manual opening operation is produced by the actuating lever via the coupling arrangement, wherein the overall pivoting region of the actuating lever starting from the starting position comprises a first pivoting region and a second pivoting region following and distinct from the first pivoting region, wherein the motorized opening operation has the capability to be triggered by an actuating stroke over the first pivoting region, wherein a surroundings warning signal from a surroundings warning unit is received by the control arrangement, and wherein upon the receipt of the surroundings warning signal by the control arrangement, the motorized opening operation is deactivated via a predetermined time delay, wherein, when the motorized opening operation is deactivated and when the coupling arrangement is in the disengaged state, engagement of the coupling arrangement is brought about by an actuating stroke over the two pivoting regions and, in the process, the transition from the first pivoting region to the second pivoting region is associated with a rise in the actuating force, and wherein a manual opening operation is produced by a subsequent actuating stroke over the two pivoting regions;

wherein the triggering lever and the pawl are distinct from each other and bearing independently of each other.

2. The method according to claim 1, wherein the surroundings warning signal is a collision warning signal, and wherein the surroundings warning unit comprises a collision sensor.

3. The method according to claim 1, wherein the deactivation of the motorized opening operation stems from currentless switching of the electric drive arrangement.

4. The method according to claim 1, wherein the coupling arrangement comprises a coupling lever which is adjusted between an engagement position, in which the actuating lever is coupled or has the capability to be coupled to the triggering lever via the coupling lever, and a disengagement position, in which the actuating lever is decoupled from the triggering lever.

5. The method according to claim 4, wherein a control contour is provided along which the coupling lever or an element coupled to the coupling lever when the coupling lever is initially in the disengagement position slides during the forwards movement of the actuating stroke and the coupling lever is thereby guided from the disengagement position in the direction of the engagement position.

6. The method according to claim 5, wherein the control contour comprises a braking contour portion which is configured in such a manner that, during the forwards movement of the actuating stroke, during the transition from the first pivoting region to the second pivoting region, an increased deflection rate of the coupling lever is generated based on the deflection of the actuating lever and therefore a rise in the actuating force.

7. The method according to claim 5, wherein during the subsequent return movement of the actuating stroke, the coupling lever or an element coupled to the coupling lever slides along the triggering lever and is thereby guided into the engagement position.

8. The method according to claim 4, wherein the coupling lever is pretensioned into the engagement position or the disengagement position, depending on the coupling state, by a tilting spring.

9. The method according to claim 4, wherein the coupling lever in the engagement position is adjusted into the disengagement position by the electric drive arrangement.

10. The method according to claim 9, wherein the coupling lever in the engagement position has the capability to be adjusted into the disengagement position in a motorized opening operation.

11. The method according to claim 1, wherein the actuating lever or an element coupled to the actuating lever is assigned a sensor arrangement for detecting the position of the actuating lever, and wherein the arrangement is undertaken in such a manner that, upon the detection of an actuating stroke over the first pivoting region, the electric drive arrangement is activated in order to generate the motorized opening operation.

12. An opening mechanism configured for carrying out the method according to claim 1.

13. The method for operating an opening mechanism which serves for opening a motor vehicle lock of claim 1, wherein the door handle comprises an inside door handle.

14. The method for operating an opening mechanism which serves for opening a motor vehicle lock of claim 1, wherein the transition from the first pivoting region to the second pivoting region is associated with an abrupt rise in the actuating force.

15. The method according to claim 1, wherein the surroundings warning signal is a collision warning signal, and wherein the surroundings warning unit comprises a distance sensor.

16. The method according to claim 1, wherein the actuating lever or an element coupled to the actuating lever is assigned a switching element, for detecting the position of the actuating lever, and wherein the arrangement is undertaken in such a manner that, upon the detection of an actuating stroke over the first pivoting region, the electric drive arrangement is activated in order to generate the motorized opening operation.

* * * * *